US010971794B2

(12) United States Patent
Smith

(10) Patent No.: US 10,971,794 B2
(45) Date of Patent: Apr. 6, 2021

(54) ANTENNA MOUNTING BRACKET ASSEMBLY

(71) Applicant: CommScope Design & Integration UK Limited, Fife (GB)

(72) Inventor: Barnaby C. Smith, Dorking (GB)

(73) Assignee: CommScope Technologies LLC, Hickory, NC (US)

( * ) Notice: Subject to any disclaimer, the term of this patent is extended or adjusted under 35 U.S.C. 154(b) by 326 days.

(21) Appl. No.: 16/048,998

(22) Filed: Jul. 30, 2018

(65) Prior Publication Data

US 2019/0058239 A1 Feb. 21, 2019

Related U.S. Application Data

(60) Provisional application No. 62/545,537, filed on Aug. 15, 2017.

(51) Int. Cl.

| | |
|---|---|
| ***H01Q 1/12*** | (2006.01) |
| ***H01Q 21/00*** | (2006.01) |
| *H01Q 1/42* | (2006.01) |
| *H01Q 1/24* | (2006.01) |

(52) U.S. Cl.
CPC ..... *H01Q 1/1242* (2013.01); *H01Q 1/1228* (2013.01); *H01Q 21/0025* (2013.01); *H01Q 1/246* (2013.01); *H01Q 1/42* (2013.01)

(58) Field of Classification Search
None
See application file for complete search history.

(56) References Cited

U.S. PATENT DOCUMENTS

| | | | | |
|---|---|---|---|---|
| 4,287,519 A * | 9/1981 | Doi | H01Q 25/00 | 343/725 |
| 5,641,141 A * | 6/1997 | Goodwin | H01Q 1/12 | 248/218.4 |
| 5,787,673 A * | 8/1998 | Noble | E04H 12/085 | 343/890 |
| 6,002,374 A * | 12/1999 | Nicholas | H01Q 1/1242 | 343/725 |
| 6,045,103 A * | 4/2000 | Costa | F16M 11/10 | 211/119.06 |
| 6,111,553 A * | 8/2000 | Steenbuck | H01Q 1/1207 | 343/891 |

(Continued)

FOREIGN PATENT DOCUMENTS

| | | |
|---|---|---|
| KR | 1020100034351 | 4/2010 |
| KR | 1020110065959 | 6/2011 |

OTHER PUBLICATIONS

International Preliminary Report on Patentability corresponding to International Application No. PCT/US2018/044011 dated Feb. 27, 2020.

(Continued)

*Primary Examiner* — Xanthia C Cunningham
(74) *Attorney, Agent, or Firm* — Myers Bigel, P.A.

(57) ABSTRACT

An assembly for mounting an antenna to a mounting structure, such as a street pole, is provided. The antenna assembly can include an tipper and a lower mounting bracket that can be attached to an antenna. Each mounting bracket has hooks designed to be inserted into pre-formed holes in the mounting structure. The antenna becomes secured to the mounting structure when the hooks latch into the pre-formed holes of the mounting structure.

18 Claims, 13 Drawing Sheets

(56) References Cited

U.S. PATENT DOCUMENTS 6,126,128 A * 10/2000 Costa ..... F16M 13/02 248/278.1
6,232,928 B1 * 5/2001 Zimmerman ..... H01Q 1/1242 343/882
6,273,377 B1 * 8/2001 Archer ..... F16B 2/065 248/218.4
6,361,007 B1 * 3/2002 Oby ..... H01Q 1/12 248/285.1
6,766,992 B1 * 7/2004 Parker ..... F16M 13/022 248/218.4
6,768,474 B2 * 7/2004 Hunt ..... H01Q 1/1228 248/218.4
7,027,006 B2 * 4/2006 Holle ..... H01Q 1/1228 343/878
7,106,273 B1 9/2006 Brunson et al.
7,161,554 B2 * 1/2007 Nugnes ..... E04B 9/006 343/878
8,011,628 B1 * 9/2011 Suddeth ..... H01Q 1/12 248/225.11
9,123,987 B2 * 9/2015 Lettkeman ..... F16M 13/02
9,196,177 B2 * 11/2015 English ..... G09F 7/18
9,303,811 B1 4/2016 Lutz, Jr. et al.
9,325,061 B2 4/2016 Rucki et al.
9,882,260 B2 * 1/2018 Mummert ..... H01Q 1/1242
9,893,410 B2 * 2/2018 Kolokotronis ..... H01Q 1/1242
10,044,091 B2 * 8/2018 DiPiero ..... H01Q 1/1228
10,218,046 B2 * 2/2019 Hendrix ..... H01Q 1/246
10,439,272 B1 * 10/2019 Rowson ..... H01Q 1/2283
2004/0108963 A1 * 6/2004 Clymer ..... H01Q 15/242 343/837
2007/0001919 A1 * 1/2007 Carroll ..... H01Q 1/246 343/757
2007/0273598 A1 * 11/2007 Kuroda ..... H01Q 1/1207 343/753
2009/0315804 A1 * 12/2009 Schmidt ..... H01Q 1/1242 343/878
2012/0211627 A1 * 8/2012 Lee ..... H01Q 1/1228 248/316.5
2015/0091777 A1 * 4/2015 Rucki ..... H01Q 1/246 343/872
2015/0144758 A1 * 5/2015 Kolokotronis ..... H01Q 1/1242 248/282.1
2016/0261030 A1 * 9/2016 Kim ..... H01Q 1/1264
2016/0352042 A1 * 12/2016 Wankoff ..... H01Q 1/246
2016/0365618 A1 * 12/2016 Kim ..... H01Q 1/1242
2017/0062944 A1 * 3/2017 Zimmerman ..... H01Q 19/062
2018/0026327 A1 * 1/2018 Hendrix ..... H04Q 1/118 455/562.1

OTHER PUBLICATIONS

Notification of Transmittal of the International Search Report and the Written Opinion of the International Searching Authority, or the Declaration corresponding to International Application No. PCT/US2018/044011 dated Nov. 12, 2018.

* cited by examiner

ANTENNA MOUNTING BRACKET ASSEMBLY

RELATED APPLICATION

The present application claims priority from and the benefit of U.S. Provisional Patent Application No. 62/545,537, filed Aug. 15, 2017, the disclosure of which is hereby incorporated herein in its entirety.

FIELD OF THE INVENTION

The present invention is directed to an assembly to mount an antenna to a mounting structure.

BACKGROUND OF THE INVENTION

Antennas for wireless communications are typically mounted on an antenna tower or other elevated mounting structure, for example a street pole. Currently, a majority of these antennas are secured to the mounting structure through use of a bolted mechanical connection. The limited space between the antennas and the mounting structure makes installation and maintenance at times difficult for a technician. Having an additional way to further secure the antennas to the mounting structure may also be beneficial from a safety perspective.

SUMMARY

As a first aspect, embodiments of the invention are directed to an, antenna assembly. The antenna assembly comprises: an antenna; a first mounting bracket mounted to the antenna comprising a first panel and a first plurality of hooks, wherein the first plurality of hooks is configured to secure the first mounting bracket to a mounting structure; and a second mounting bracket mounted, to the antenna comprising a second panel and a second plurality of hooks, wherein the second plurality of hooks is configured to secure the second mounting bracket to the mounting structure. The first mounting bracket and the second mounting bracket are configured to secure the antenna to the mounting structure.

As a second aspect, embodiments of the invention are directed to an antenna assembly comprising: an antenna; a mounting structure; a first mounting bracket mounted to the antenna comprising a first panel and a first plurality of hooks; and a second mounting bracket mounted to the antenna comprising a second panel and a second plurality of hooks. The first and second pluralities of hooks are inserted into pre-formed holes in the mounting structure.

As a third aspect an antenna assembly comprising: three antennas; a mounting structure; a first mounting bracket mounted to each antenna, wherein each first mounting bracket comprises a first panel and a first plurality of hooks; and a second mounting bracket mounted to each antenna, wherein each second mounting bracket comprises a second panel and a second plurality of hooks. The antennas are secured to the mounting structure when the first and second pluralities of hooks of each respective antenna are inserted into pre-formed holes in the mounting structure.

DETAILED DESCRIPTION OF THE INVENTION

Figure 1:
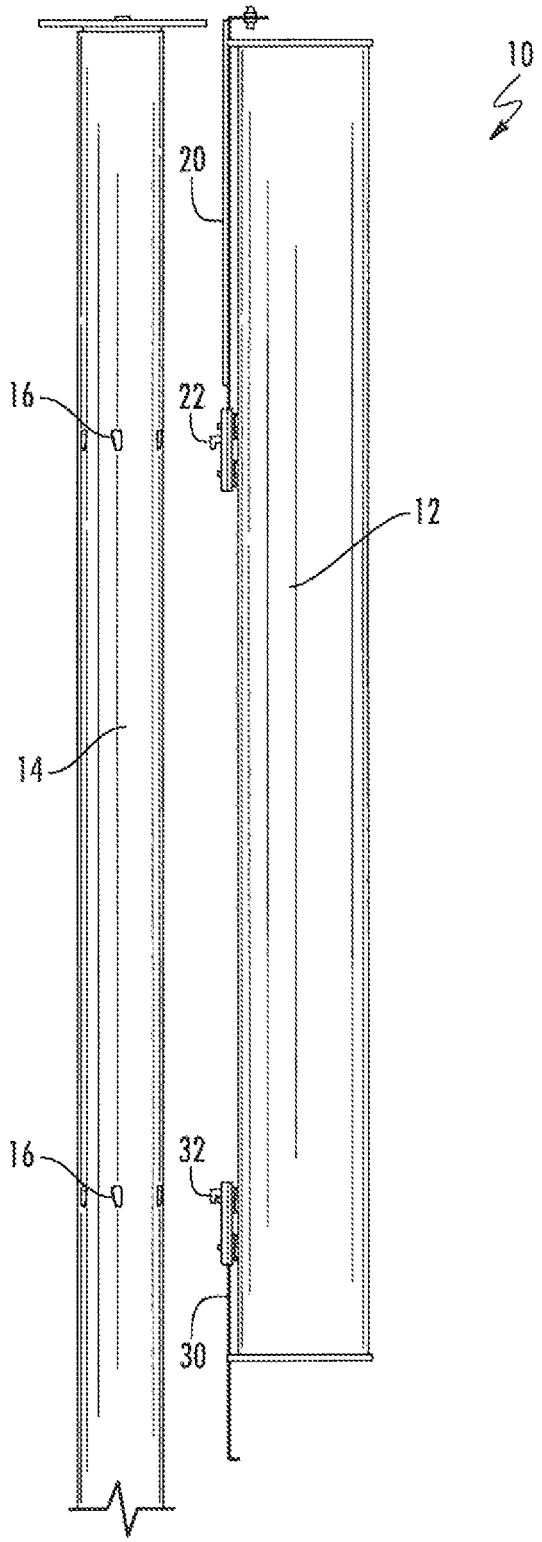
FIG. 1 is a side view of an antenna assembly according to embodiments of the present invention.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an", and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or, more of the associated listed items.

Referring now to the figures, an antenna assembly 10 for mounting an antenna 12 is illustrated in FIGS. 1-12. The antenna assembly 10 is described herein in connection with antennas attached to a street pole. This particular application is described for exemplary purposes only. The antenna assembly 10 may be used to secure other types of antennas to different types of structures.

In one embodiment of the present invention, the antenna assembly 10 comprises a first upper mounting bracket 20 and second lower mounting bracket 30 (FIG. 1). The upper and lower mounting brackets 20, 30 are mounted to an antenna 12 and are configured to secure the antenna 12 to a mounting structure 14, such as a street pole or the like.

Figure 2:
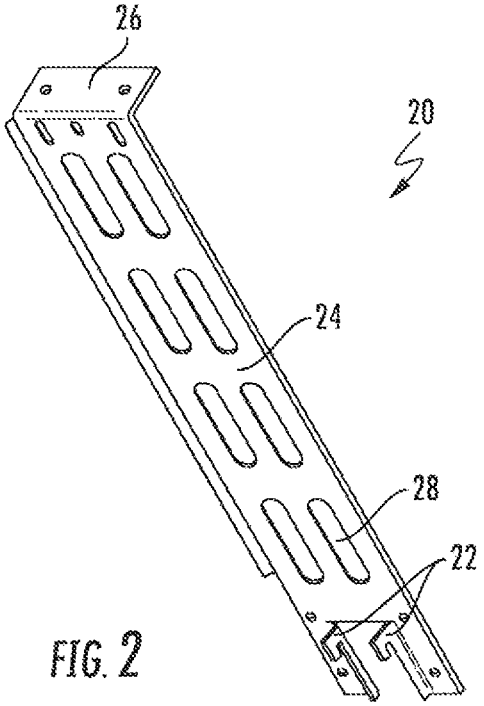
FIG. 2 is a perspective view of the upper mounting bracket of the antenna assembly of FIG. 1.
Figure 3:
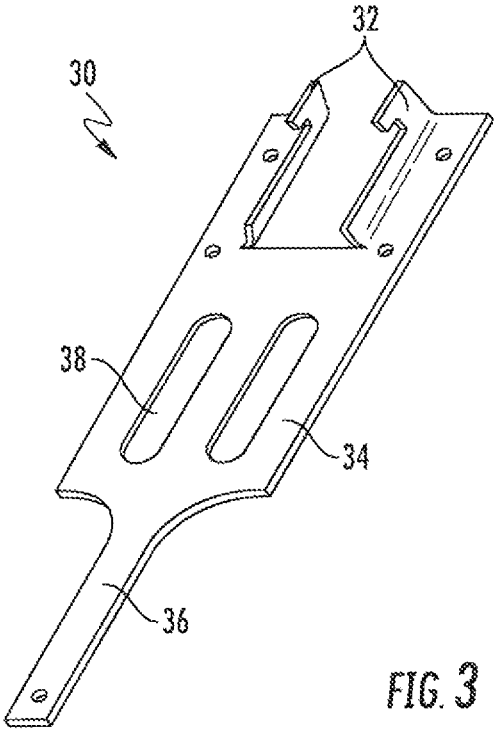
FIG. 3 is a perspective view of the lower mounting bracket of the antenna assembly of FIG. 1.

The upper mounting bracket 20 comprises a panel 24 and two hooks 22 (FIG. 2). The hooks 22 are configured to secure the upper mounting bracket 20 to the mounting structure 14 (FIG. 1). The lower mounting bracket 30 also comprises a panel 34 and two hooks 32 (FIG. 3). Like the hooks 22 of the upper mounting bracket 20, the hooks 32 are configured to secure the lower mounting bracket to the mounting structure 14 (FIG. 1). Note that the present invention is not limited to the number of hooks 22, 32 that may be, used. Any number of hooks 22, 32 may be used to secure the antenna 12 to a mounting structure 14.

In some embodiments, the panels 24, 34 may comprise holes 28, 38. The holes 28, 38 reduce the overall weight of the upper and lower mounting brackets 20, 30. Reducing the overall weight has many advantages including, but not limited to, ease of use and cost savings. These holes 28, 38 can take the form of a variety of different shapes (e.g., holes, slots) and sizes, so long as the structural integrity of the brackets 20, 30 is not affected.

In FIGS. 2 and 3, the upper and lower brackets 20, 30 are shown as separate brackets; however, the brackets 20, 30 may form a monolithic structure.

Figure 4:
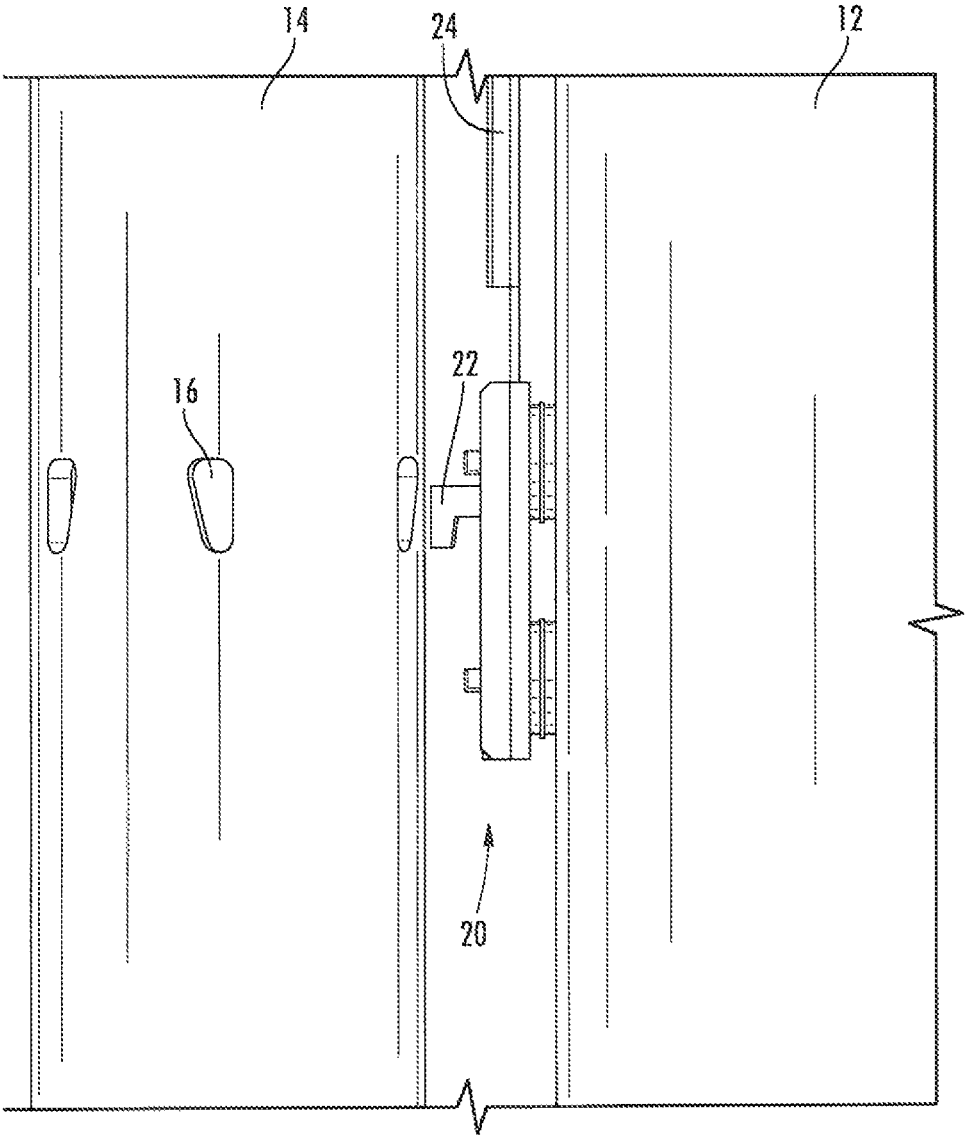
FIG. 4 is a side view of the upper mounting bracket of the antenna assembly of FIG. 1.
Figure 5:
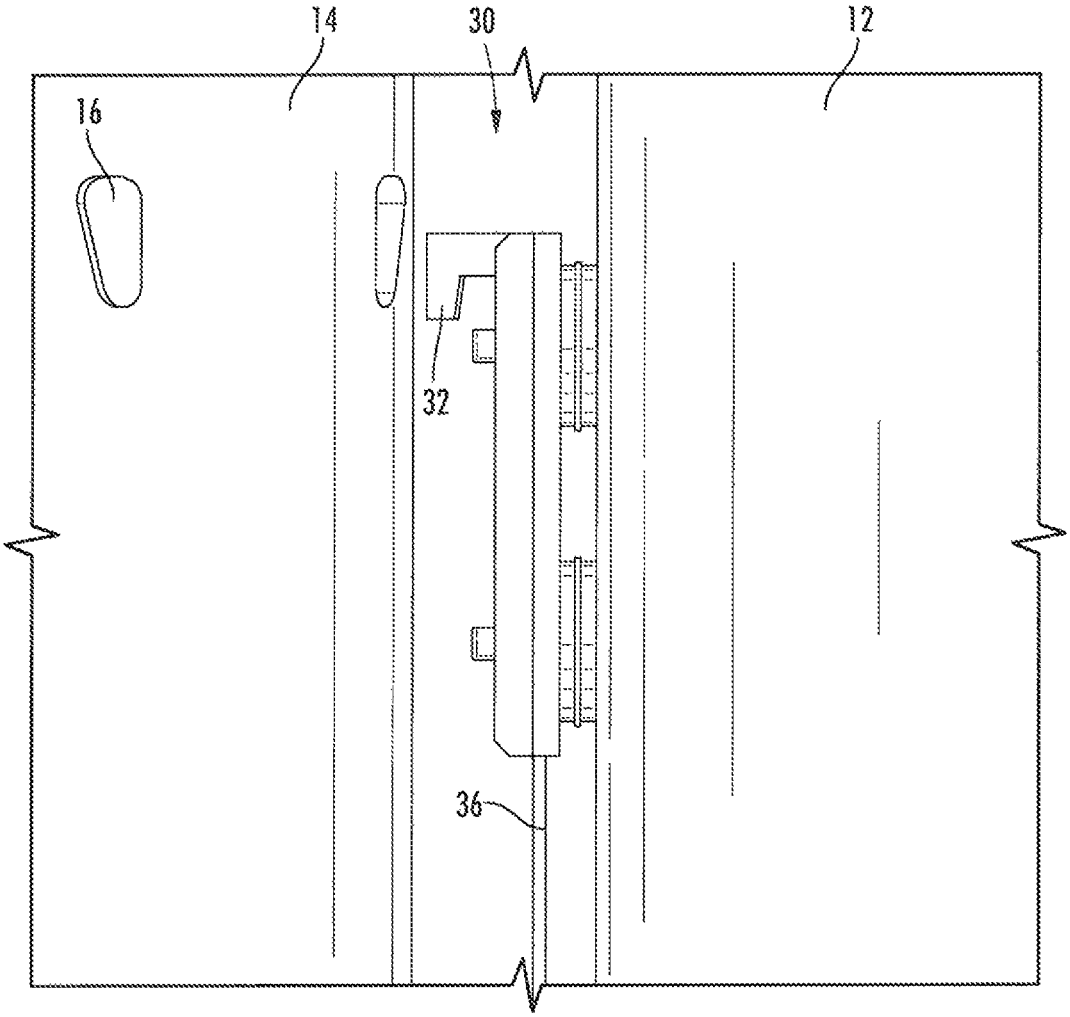
FIG. 5 is a side view of the lower mounting bracket of the antenna assembly or FIG. 1.

In some embodiments, the hooks 22, 32 are configured to be inserted into pre-formed holes 16 in the mounting structure 14 (FIGS. 4 and 5). Once the hooks 22, 32 are inserted into the pre-formed holes 16, the antenna 12 becomes secured to the mounting structure 14 (FIGS. 8A-D).

The hooks 22, 32 can take the form of a variety of different shapes and sizes and are not limited to the shapes and sizes as illustrated in FIGS. 2 and 3. The shape and size of the hooks 22, 32 may be dependent on the shape and size of the pre-formed holes 16 or vice versa. Alternatively, other latching mechanisms may be used.

Figure 6:
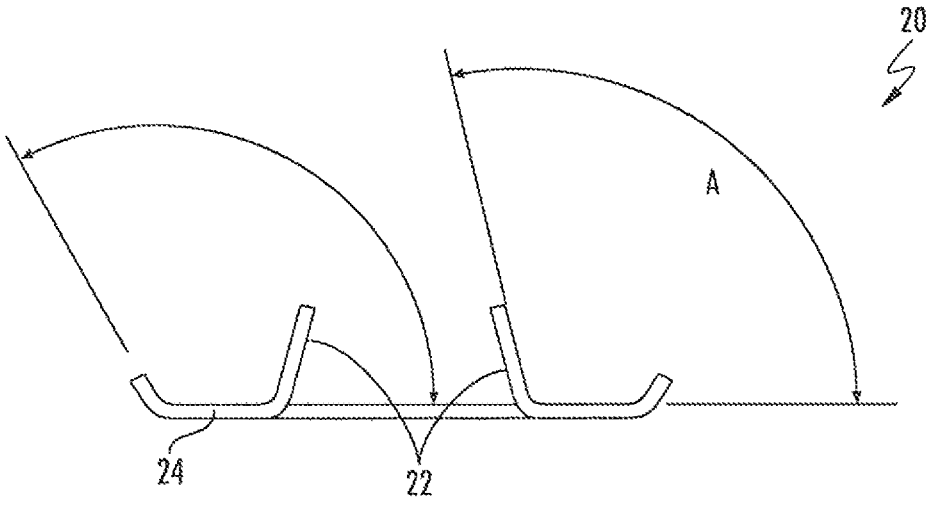
FIG. 6 is a top view of upper mounting bracket of the antenna assembly of FIG. 1.

In some embodiments, each of the hooks 22 may be configured at an angle (A) greater than 90 degrees with respect to the panel 24 of the upper mounting bracket 20 (FIG. 6). The angle (A) may match the curvature of the mounting structure 14 which allows the hooks 22 to more easily latch onto the mounting structure 14 when inserted into the pre-formed holes 16, thus, improving the mounting of the antenna 12 to the mounting structure 14. In some embodiments, each of the hooks 22 may be perpendicular to the panel 24 (i.e., 90 degrees).

Figure 7:
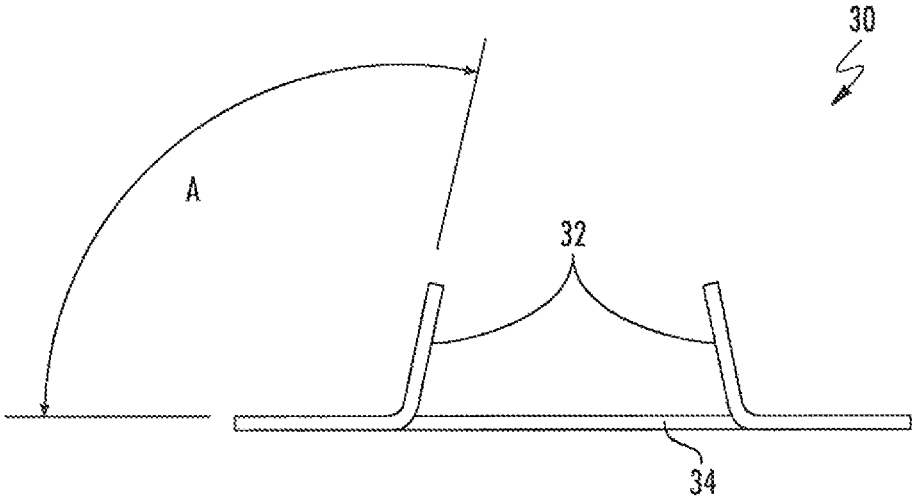
FIG. 7 is a top view of the lower mounting bracket of the antenna assembly of FIG. 1.

In some embodiments, the hooks 32 may be configured at an angle (A) greater than 90 degrees with respect to the panel 34 of the lower mounting bracket 30 (FIG. 7). Similar to the hooks 22, the angle (A) may match the curvature of the mounting structure 14 which allows the hooks 32 to more easily latch onto the mounting structure 14 when inserted into the pre-formed holes 16 improving the mounting of the antenna 12 to the mounting structure 14. In some embodiments, each of the hooks 32 may be perpendicular to the panel 34 (i.e., 90 degrees).

Figure 8A:
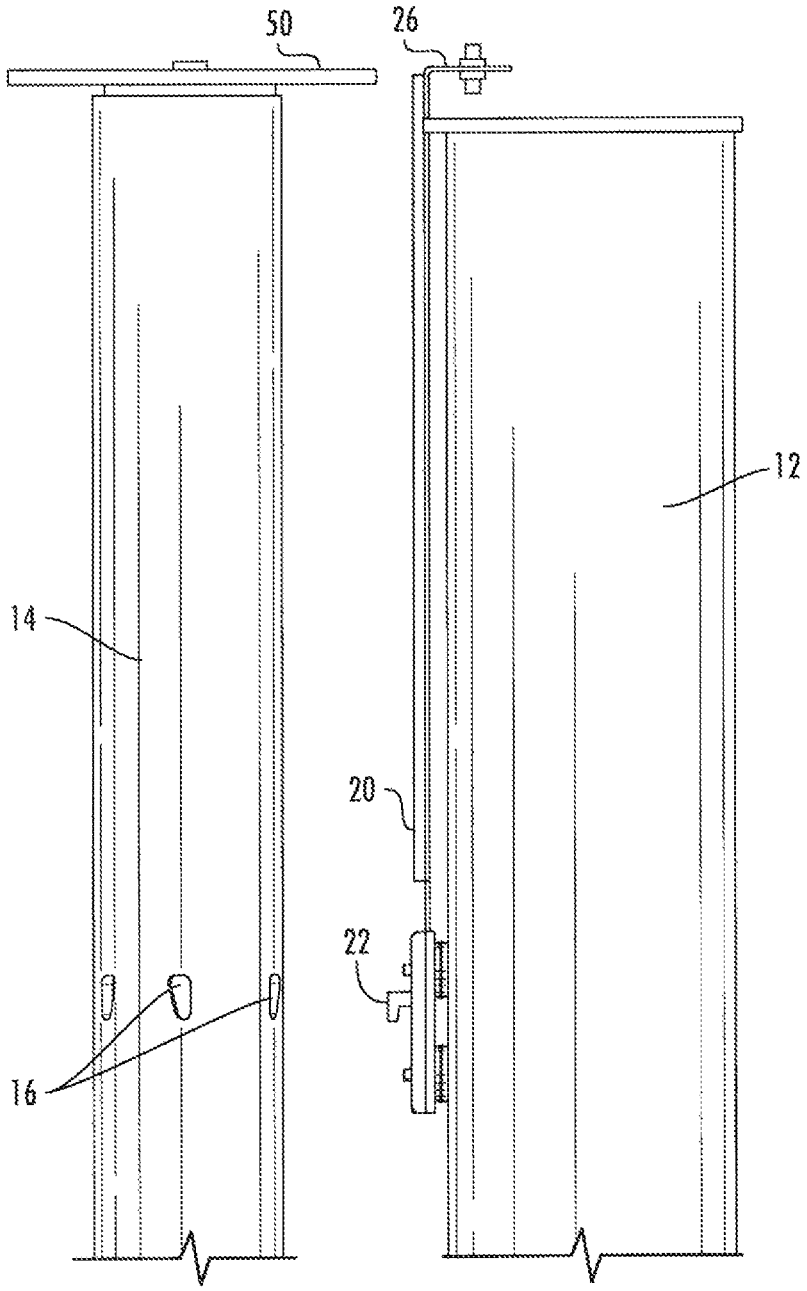
FIGS. 8A-D is a side view of an antenna assembly secured to a mounting bracket according, to embodiments of the present invention.
Figure 8B:
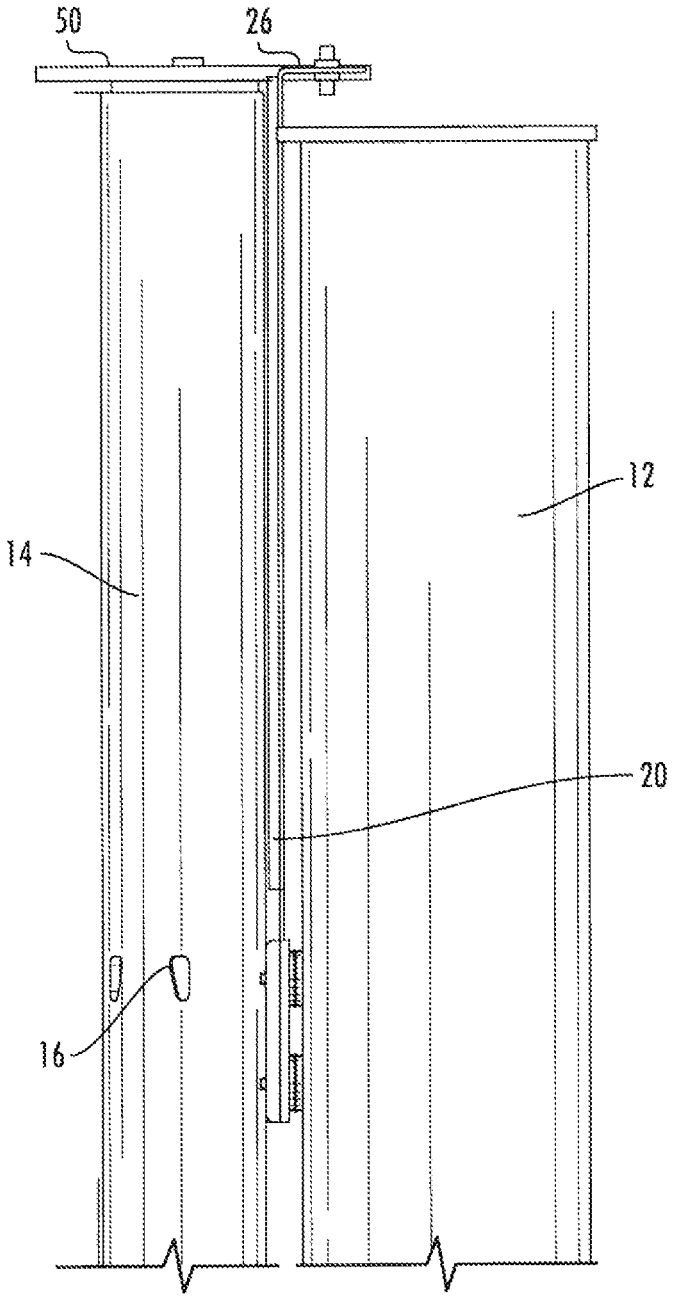
Figure 8C:
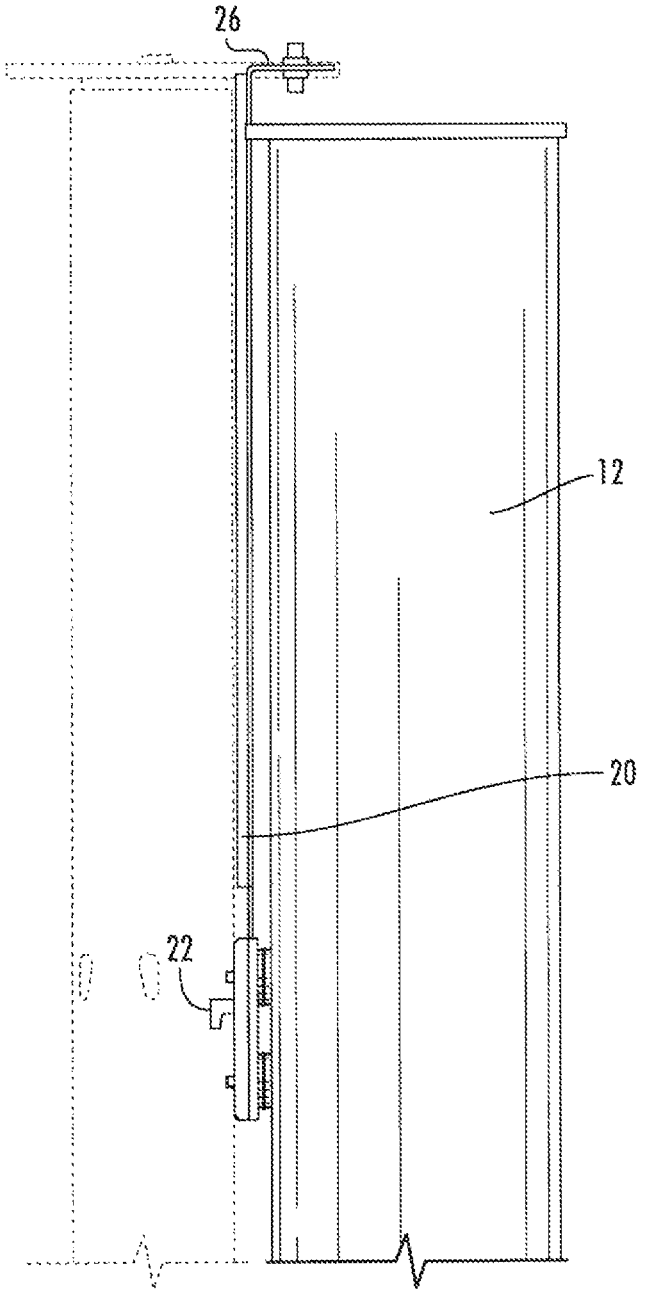
Figure 8D:
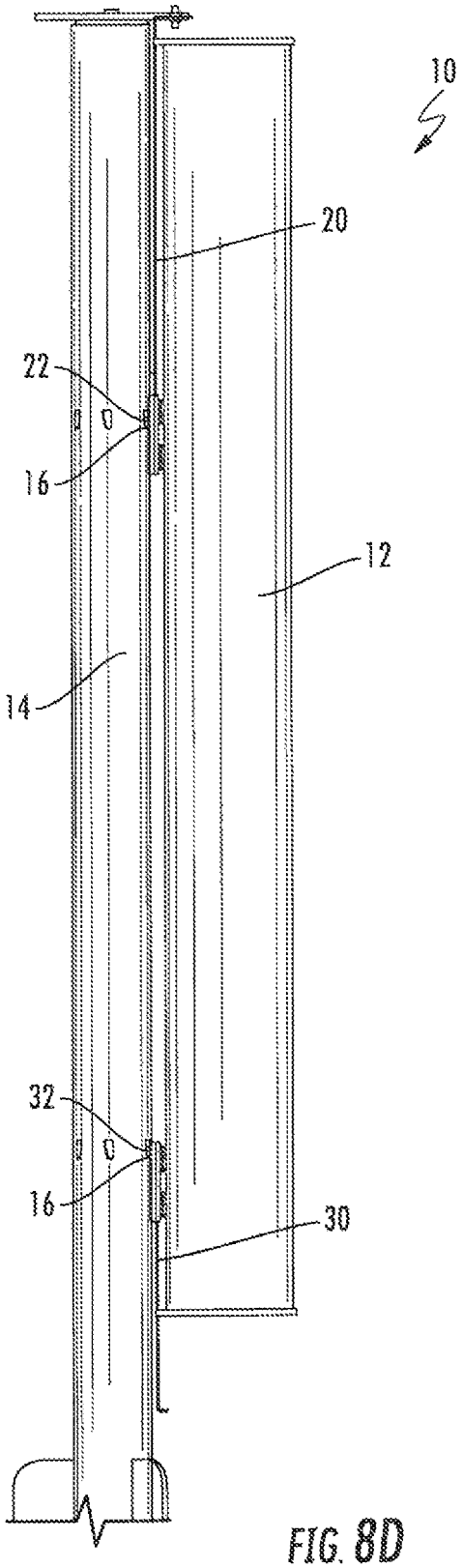

In some embodiments, the upper mounting bracket 20 further comprises a flange 26 that is perpendicular to the panel 24 (FIG. 2). The flange 26 is configured to further secure the upper mounting, bracket 20 to the mounting structure 14 in the manner discussed below (FIGS. 8A-C).

In some embodiments, the lower mounting bracket 30 further comprises an extension 36 that is parallel to the panel 34 (FIG. 3). The extension 36 is configured to further secure the lower mounting bracket 30 to the mounting structure 14 in the manner discussed below.

Figure 9:
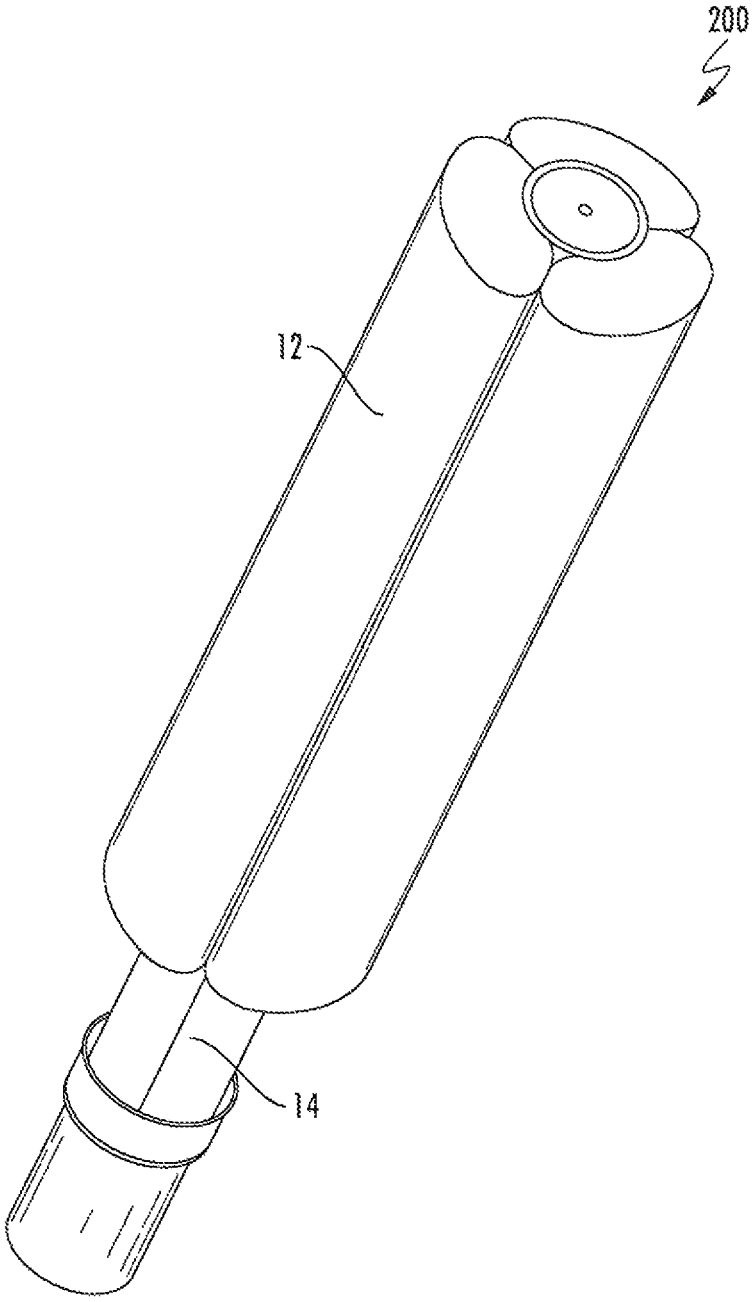
FIG. 9 is a perspective view showing three antennas using an antenna assembly according to embodiments of the present invention.

Three antenna assemblies 10 can be mounted on the mounting structure 14 to form a complete antenna system 200 with full coverage (FIG. 9). Like described above, each antenna 12 is secured to the mounting structure 14 by inserting the hooks 22, 32 into the pre-formed holes 16 in the mounting structure 14.

Additionally, if the mounting structure 14 does not have pre-formed holes 16, holes can be created in the field to accommodate the mounting brackets 20, 30 of the present invention.

As noted above, in some embodiments, the upper mounting bracket 20 of each antenna 12 further comprises a flange 26 that is perpendicular to the panel 24. Each flange 26 may be secured by a cap 50 or other securing device mounted on the top portion of the mounting structure 14 (FIGS. 8A-C and 11). This configuration helps further secure each respective antenna 12 to the mounting structure 14.

Also, as noted above, in some embodiments, the lower mounting bracket 30 of each antenna 12 further comprises an extension 36 that is parallel to the panel 34. Each extension 36 may be secured to the mounting structure 14 via a band clamp 60 (FIG. 12) or other securing device. This configuration helps further secure each respective antenna 12 to the mounting structure 14.

The dimensions of the upper and lower mounting brackets 20, 30 can vary based on the size of the antenna 12 and mounting structure 14 to which the antenna 12 is being mounted. For example, the upper mounting bracket 20 may be about 720 millimeters by about 125 millimeters. The lower mounting bracket 30, for example, may be about 410 millimeters (including extension 26) by about 125 millimeters. The hooks 22, 32 may extend about 28 millimeters from the panels 24, 34. For brackets 20, 30 comprising two hooks 22, 32, the hooks 22, 32 may be about 70 millimeters apart from each other. The spacing of the hooks 22, 32 can vary based on the dimensions (e.g., diameter) of the mounting structure 14. The typical diameter of the mounting structure 14 may be about 127 millimeters.

Figure 10:
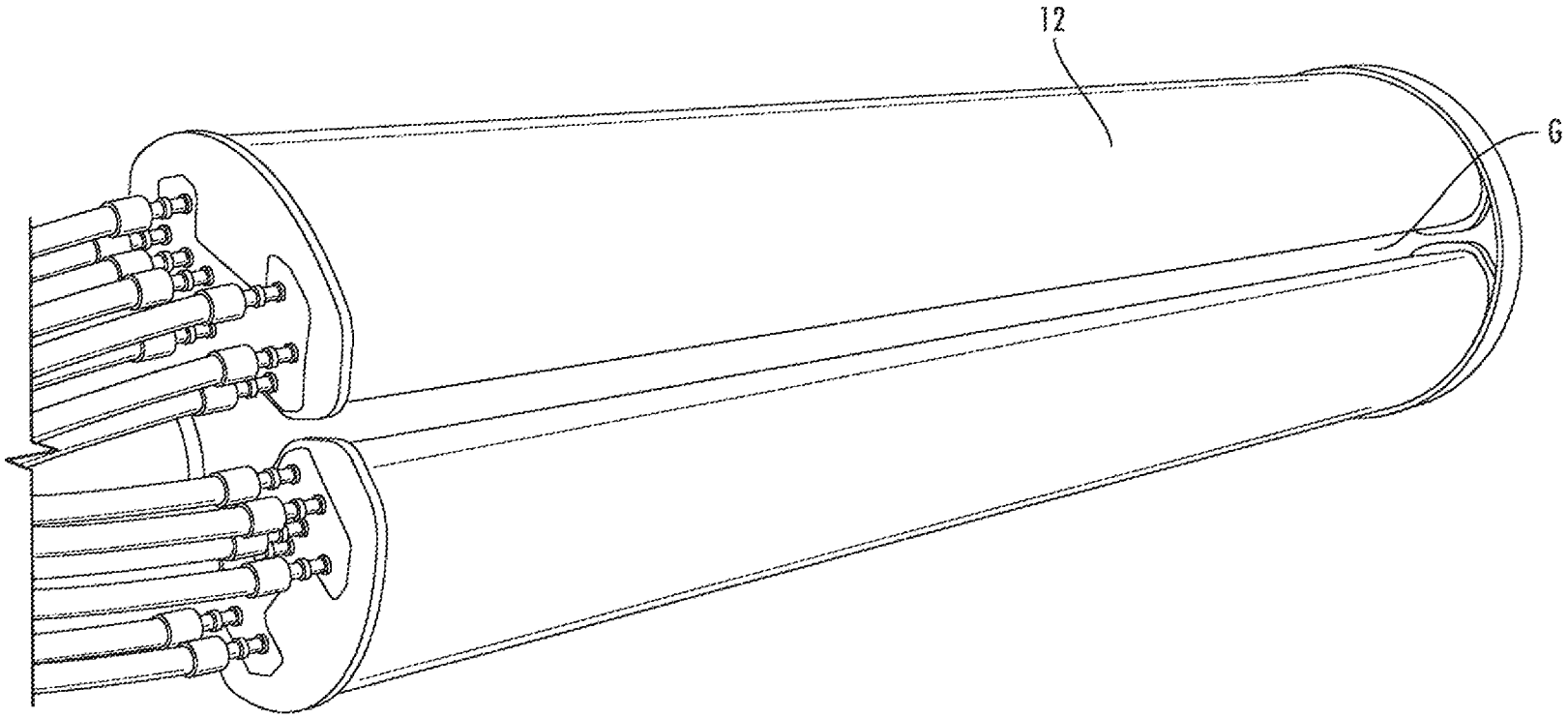
FIG. 10 is a perspective view of the antenna assembly of FIG. 9 with cables attached thereto.
Figure 11:
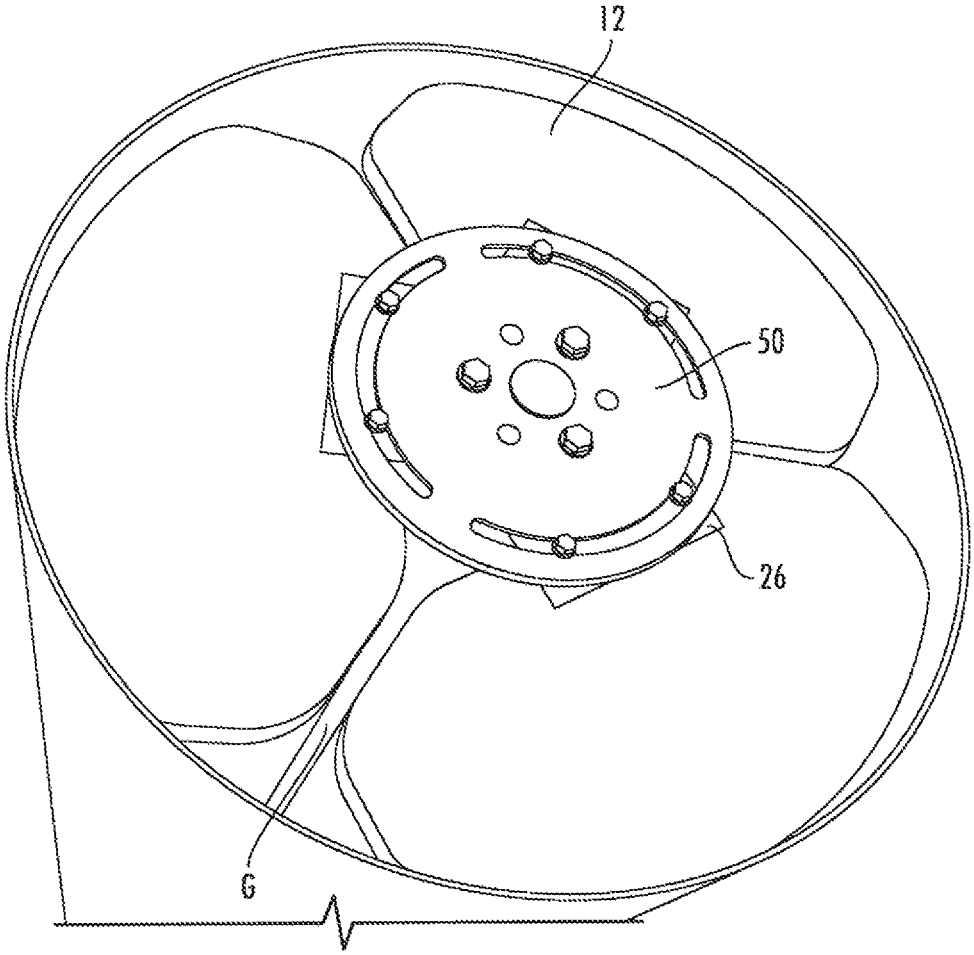
FIG. 11 is a top perspective view of the antenna assembly of FIG. 9 showing attachment of the upper mounting brackets to a pole via a cap.
Figure 12:
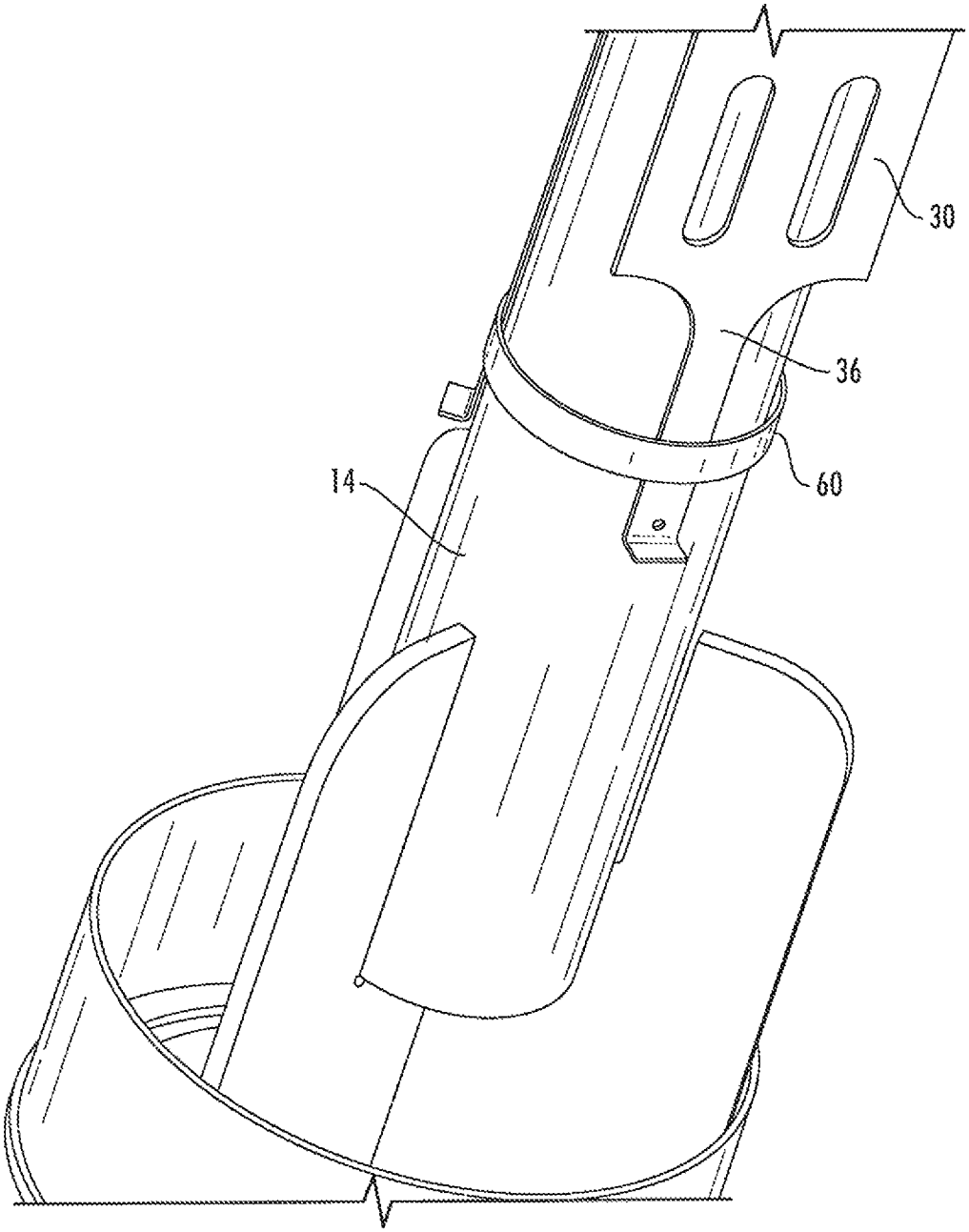
FIG. 12 is an enlarged partial perspective view of the antenna assembly of FIG. 9 showing attachment of the lower brackets to a pole via a band clamp.

In some embodiments, when each of the three antennas 12 is secured to the mounting structure 14, the side edge of each antenna may be immediately adjacent to a side edge of an adjacent antenna 12 (FIGS. 10 and 11). In some embodiments, between the side edges of each antenna 12 is a small gap (G). The gap (G) may be between about 0 millimeters and about 20 millimeters. The gap (G) can vary based on the type of antenna 12 being used. Because of the limited space between the antennas 12, use of the upper and lower mounting brackets 20, 30 may significantly facilitate mounting of the antennas 12.

The antenna assemblies of the present invention can be formed from a variety of materials that can withstand a wide range of environmental conditions, but the mounting brackets must be comprised from a material that is able to at least support the weight of the antenna(s). In some embodiments, the antenna assemblies may be formed from galvanized steel, stainless steel, or the like.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An antenna assembly, comprising:

an antenna;

a first mounting bracket mounted to the antenna comprising a first panel and a first plurality of hooks, wherein the first plurality of hooks is configured to secure the first mounting bracket to a mounting structure; and a second mounting bracket mounted to the antenna comprising a second panel and a second plurality of hooks, wherein the second plurality of hooks is configured to secure the second mounting bracket to the mounting structure;

wherein each of the first plurality of hooks defines a respective first plane in which it extends from the first panel, and wherein each of the first planes defines an angle greater than 90 degrees with respect to the first panel;

wherein the first mounting bracket and the second mounting bracket are configured to secure the antenna to the mounting structure.

2. The antenna assembly of claim 1, wherein each of the second plurality of hooks defines a respective second plane in which it extends from the second panel, and wherein each of the second planes defines an angle greater than 90 degrees with respect to the second panel of the second mounting bracket.

3. The antenna assembly of claim 1, wherein the first mounting bracket further comprises a flange perpendicular to the first panel configured to further secure the first mounting bracket, the flange extending above the antenna.

4. The antenna assembly of claim 1, wherein the second mounting bracket further comprises an extension parallel to the second panel configured to further secure the second mounting bracket.

5. The antenna assembly of claim 1, wherein the first and second pluralities of hooks are configured to insert into pre-formed holes in the mounting structure to secure the antenna to the mounting structure.

6. The antenna assembly of claim 1, wherein the antenna assembly comprises galvanized or stainless steel.

7. The antenna assembly of claim 1, wherein the first and second mounting brackets comprise holes.

8. An antenna assembly, comprising:

an antenna;

a mounting structure;

a first mounting bracket mounted to the antenna comprising a first panel and a first plurality of hooks; and a second mounting bracket mounted to the antenna comprising a second panel and a second plurality of hooks;

wherein the first and second pluralities of hooks are inserted into pre-formed holes in the mounting structure; and wherein the first mounting bracket further comprises a flange perpendicular to the first panel that extends above the antenna, the flange configured to secure the mounting bracket to the mounting structure.

9. The antenna assembly of claim 8, wherein each of the first plurality of hooks defines a respective first plane in which it extends from the first panel, and wherein each of the first planes defines at an angle greater than 90 degrees with respect to the first panel of the first mounting bracket.

10. The antenna assembly of claim 8, wherein each of the second plurality of hooks defines a respective second plane in which it extends from the second panel, and wherein each of the second planes defines at an angle greater than 90 degrees with respect to the second panel of the second mounting bracket.

11. The antenna assembly of claim 8, wherein the second mounting bracket further comprises an extension parallel to the second panel configured to further secure the second mounting bracket.

12. The antenna assembly of claim 8, wherein the first and second pluralities of hooks are configured to insert into pre-formed holes in the mounting structure to secure the antenna to the mounting structure.

13. The antenna assembly of claim 8, wherein the antenna assembly comprises galvanized or stainless steel.

14. An antenna assembly, comprising:

three antennas;

a mounting structure, wherein the three antennas are arranged around the mounting structure to generally define a cylinder;

a first mounting bracket mounted to each antenna, wherein each first mounting bracket comprises a first panel and a first plurality of hooks; and a second mounting bracket mounted to each antenna, wherein each second mounting bracket comprises a second panel and a second plurality of hooks, wherein the antennas are secured to the mounting structure when the first and second pluralities of hooks of each respective antenna are inserted into pre-formed holes in the mounting structure.

15. The antenna assembly of claim 14, wherein a side edge of each antenna is immediately adjacent a side edge of an adjacent antenna.

16. The antenna assembly of claim 15, wherein a gap between about 0 millimeters and about 20 millimeters is located between the side edge of each antenna.

17. The antenna assembly of claim 14, wherein each of the first plurality of hooks defines a respective first plane in which it extends from the first panel, and wherein each of the first planes defines at an angle greater than 90 degrees with respect to the first panel of the first mounting bracket.

18. The antenna assembly of claim 14, wherein each of the second plurality of hooks defines a respective second plane in which it extends from the second panel, and wherein each of the second planes defines at an angle greater than 90 degrees with respect to the second panel of the second mounting bracket.

* * * * *